US008935865B2

(12) United States Patent
Bienfang et al.

(10) Patent No.: US 8,935,865 B2
(45) **Date of Patent: *Jan. 20, 2015**

(54) POWER SHOVEL HAVING ISOLATED HYDRAULIC DIPPER ACTUATOR

(71) Applicant: Caterpillar Inc., Peoria, IL (US)

(72) Inventors: David Thomas Bienfang, Racine, WI (US); Frank Richard Szpek, Jr., Franklin, WI (US)

(73) Assignee: Caterpillar Inc., Peoria, IL (US)

( * ) Notice: Subject to any disclaimer, the term of this patent is extended or adjusted under 35 U.S.C. 154(b) by 109 days.

This patent is subject to a terminal disclaimer.

(21) Appl. No.: 13/748,097

(22) Filed: Jan. 23, 2013

(65) Prior Publication Data

US 2014/0205414 A1 Jul. 24, 2014

(51) Int. Cl.
*E02F 3/30* (2006.01)
*E02F 3/407* (2006.01)

(52) U.S. Cl.
CPC ..... *E02F 3/4075* (2013.01)
USPC ..... 37/445

(58) Field of Classification Search
CPC ..... E02F 3/304; E02F 3/4075; E02F 3/425; E02F 3/308; E02F 3/40; F16D 55/00; F16D 2121/02
USPC ..... 37/398, 442–445, 195, 466; 414/565, 414/699, 706, 715, 726; 60/469; 188/217, 188/312, 317; 294/119.4, 192
See application file for complete search history.

(56) References Cited

U.S. PATENT DOCUMENTS

| | | | | |
|---|---|---|---|---|
| 2,164,126 | A | 6/1939 | Stevens | |
| 4,046,270 | A | 9/1977 | Baron et al. | |
| 4,063,373 | A * | 12/1977 | Greer et al. | 37/444 |
| 4,074,770 | A | 2/1978 | Frisbee | |
| 4,517,756 | A | 5/1985 | Olds et al. | |
| 5,829,949 | A | 11/1998 | Brown | |
| 5,839,213 | A | 11/1998 | Abbott et al. | |
| 6,219,946 | B1 | 4/2001 | Soczka | |
| 6,467,202 | B1 | 10/2002 | Brown, Jr. | |
| 7,096,610 | B1 | 8/2006 | Gilmore | |
| 8,136,272 | B2 | 3/2012 | Hren et al. | |
| 8,732,994 | B2 * | 5/2014 | Dube et al. | 37/445 |
| 2011/0146114 | A1 | 6/2011 | Hren et al. | |
| 2011/0239494 | A1 | 10/2011 | Dubé et al. | |

OTHER PUBLICATIONS

"Electric Mining Shovel Productivity Enhancements: Using Innovation to Increase Machine Availability" by Doll, Robert J., pp. 1-7., Bucyrus International, 1100 Milwaukee Avenue, South Milwaukee, WI, USA.

(Continued)

*Primary Examiner* — Robert Pezzuto
(74) *Attorney, Agent, or Firm* — Finnegan, Henderson, Farabowm, Garrett & Dunner LLP

(57) ABSTRACT

A hydraulic system for a power shovel may have a cylinder operatively connectable to a dipper door of the power shovel, a reservoir located at and fluidly connected to the cylinder, and an accumulator located at and fluidly connected to the cylinder in parallel with the reservoir. The hydraulic system may further have a control valve disposed between the cylinder, the reservoir, and the accumulator. The control valve may be movable to selectively direct fluid from the cylinder into the accumulator and fluid from the reservoir into the cylinder.

20 Claims, 4 Drawing Sheets

(56) References Cited

OTHER PUBLICATIONS

U.S. Patent Application of David Thomas Bienfang et al., entitled "Maching Having Dipper Actuator System" filed on Jan. 23, 2013.

U.S. Patent Application of David Thomas Bienfang, entitled "Power Shovel Having Isolated Hydraulic Dipper Actuator" filed on Jan. 23, 2013.

* cited by examiner

POWER SHOVEL HAVING ISOLATED HYDRAULIC DIPPER ACTUATOR

TECHNICAL FIELD

The present disclosure is directed to a dipper actuator and, more particularly, to a power shovel having an isolated hydraulic dipper actuator.

BACKGROUND

Power shovels are in a category of excavation equipment used to remove large amounts of overburden and ore during a mining operation. One type of power shovel is known as a rope shovel. A rope shovel includes a boom, a dipper handle pivotally connected to a mid-point of the boom, and a shovel (also known as a dipper) pivotally connected at one end of the dipper handle. A cable extends over a pulley at a distal end of the boom and terminates at the end of the dipper handle supporting the shovel. The cable is reeled in or spooled out by electric, hydraulic, and/or mechanical motors to selectively raise and lower the shovel.

In most rope shovels, the shovel includes a door that is selectively swung open to dump material from the shovel into a waiting haul vehicle. The door is pivotally connected at one edge to a shovel body, and mechanically latched at an opposing edge. A cable (historically a rope and, hence, the term "rope shovel") extends from an operator cabin over a boom-mounted pulley to the shovel latch. In this configuration, an operator can actuate the latch from inside a cabin of the shovel by tensioning the cable. When the shovel is held vertically, tensioning the cable causes the latch to release the door and the door falls open under the force of gravity. When the shovel is held horizontally, the door swings shut against the shovel body under the force of gravity, and the latch is biased to re-engage and hold the door in the closed position.

Although adequate for some applications, use of the cable to manually cause actuation of the dipper latch can be problematic. In particular, typical latches and associated cable linkages are under tremendous strain and cycle continuously. As a result, these components suffer high-cycle fatigue and must be serviced frequently to ensure that the latch operates effectively when manipulated by the operator via the cable. This frequent servicing results in machine downtime and lost productivity. Accordingly, an alternative source of power and control at the dipper latch is desired.

One attempt to improve durability of the dipper is disclosed in U.S. Pat. No. 8,136,272 that issued to Hren et al. on Mar. 20, 2012 ("the '272 patent"). Specifically, the '272 patent discloses a dipper door latch having a hydraulic cylinder that is remotely activated to selectively lock and unlock movement of the door. The cylinder is a double-acting cylinder having opposing chambers connected to each other by way of a closed loop. A solenoid operated valve, powered by a battery pack located at the dipper, controls fluid flow between the chambers in response to a remotely-transmitted signal from the operator. An accumulator is connected to the loop to accommodate volume differences between the chambers.

Although the dipper door latch of the '272 patent may have improved durability because it no longer requires mechanical connection to the cab of the power shovel, it may still be problematic. In particular, the double-acting nature of the cylinder increases a complexity of the latch and the potential for malfunction. In addition, the dipper door, to which the latch is connected, has a large amount of kinetic energy that is not captured and reused. Further the location and configuration of the latch and hydraulic cylinder could result in elevated wear.

The power shovel and dipper actuator of the present disclosure solve one or more of the problems set forth above.

SUMMARY

In one aspect, the present disclosure is directed to a hydraulic system for a power shovel. The hydraulic system may include a cylinder operatively connectable to a dipper door of the power shovel, a reservoir located at and fluidly connected to the cylinder, and an accumulator located at and fluidly connected to the cylinder in parallel with the reservoir. The hydraulic system may further include a control valve disposed between the cylinder, the reservoir, and the accumulator. The control valve may be movable to selectively direct fluid from the cylinder into the accumulator and fluid from the reservoir into the cylinder.

In another aspect, the present disclosure is directed to another hydraulic system for a power shovel. This hydraulic system may include a cylinder operatively connectable between a dipper body and a base edge of a dipper door, and an accumulator fluidly connected to the cylinder. The hydraulic system may also include a control valve disposed between the cylinder and the accumulator. The control valve may be movable to selectively actuate the cylinder to release and lock pivoting movement of the dipper door.

In yet another aspect, the present disclosure is directed to a method of operating a power shovel. The method may include releasing fluid from a cylinder to allow a dipper door of the power shovel to pivot in a first direction under the force of gravity, and accumulating high-pressure fluid discharged from the cylinder during pivoting of the dipper door in the first direction. The method may also include directing low-pressure fluid from a reservoir into the cylinder during pivoting of the dipper door in a second direction under the force of gravity.

DETAILED DESCRIPTION

Figure 1:
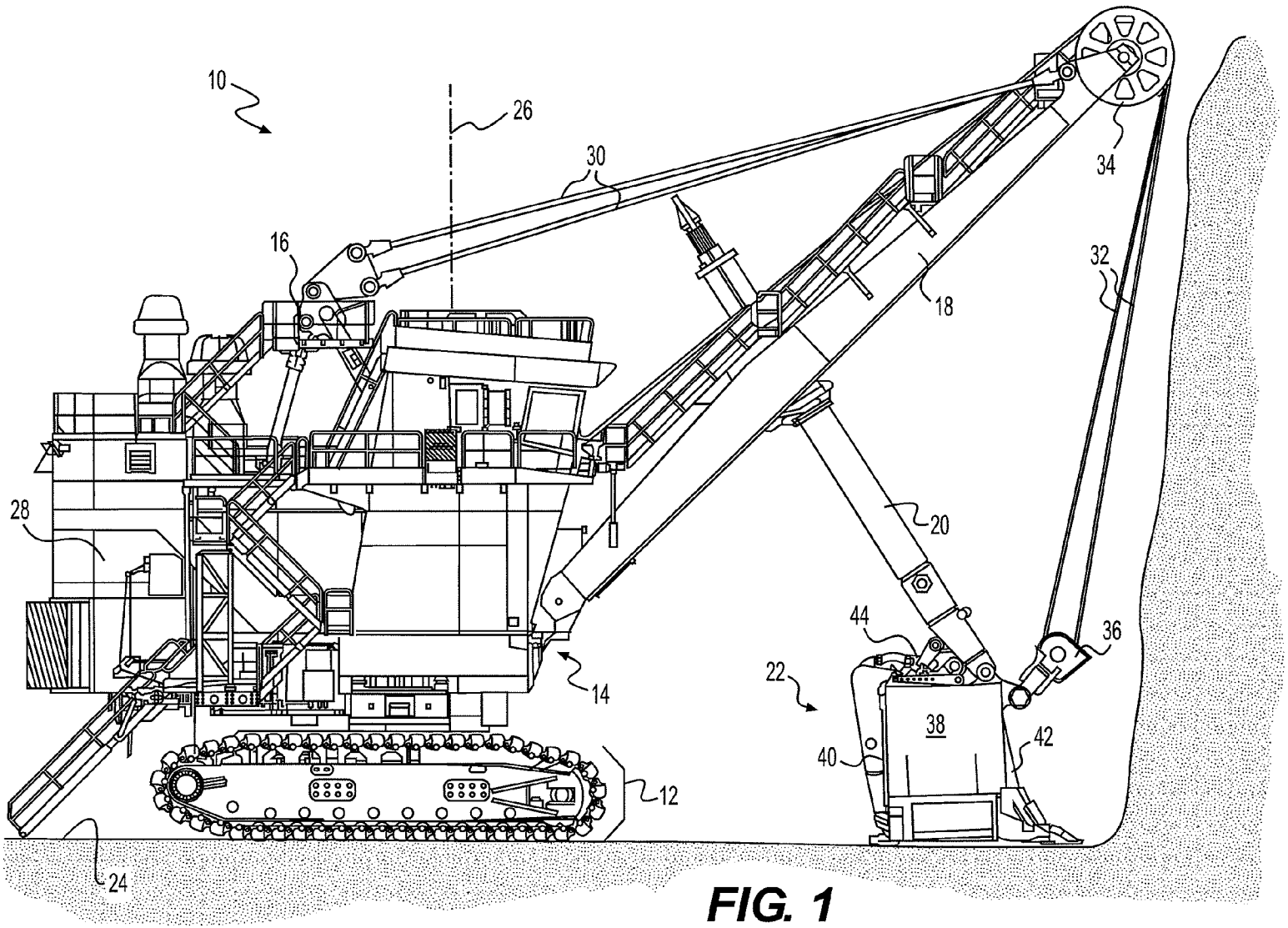
FIG. 1 is a diagrammatic illustration of an exemplary disclosed machine.
Figure 1A:
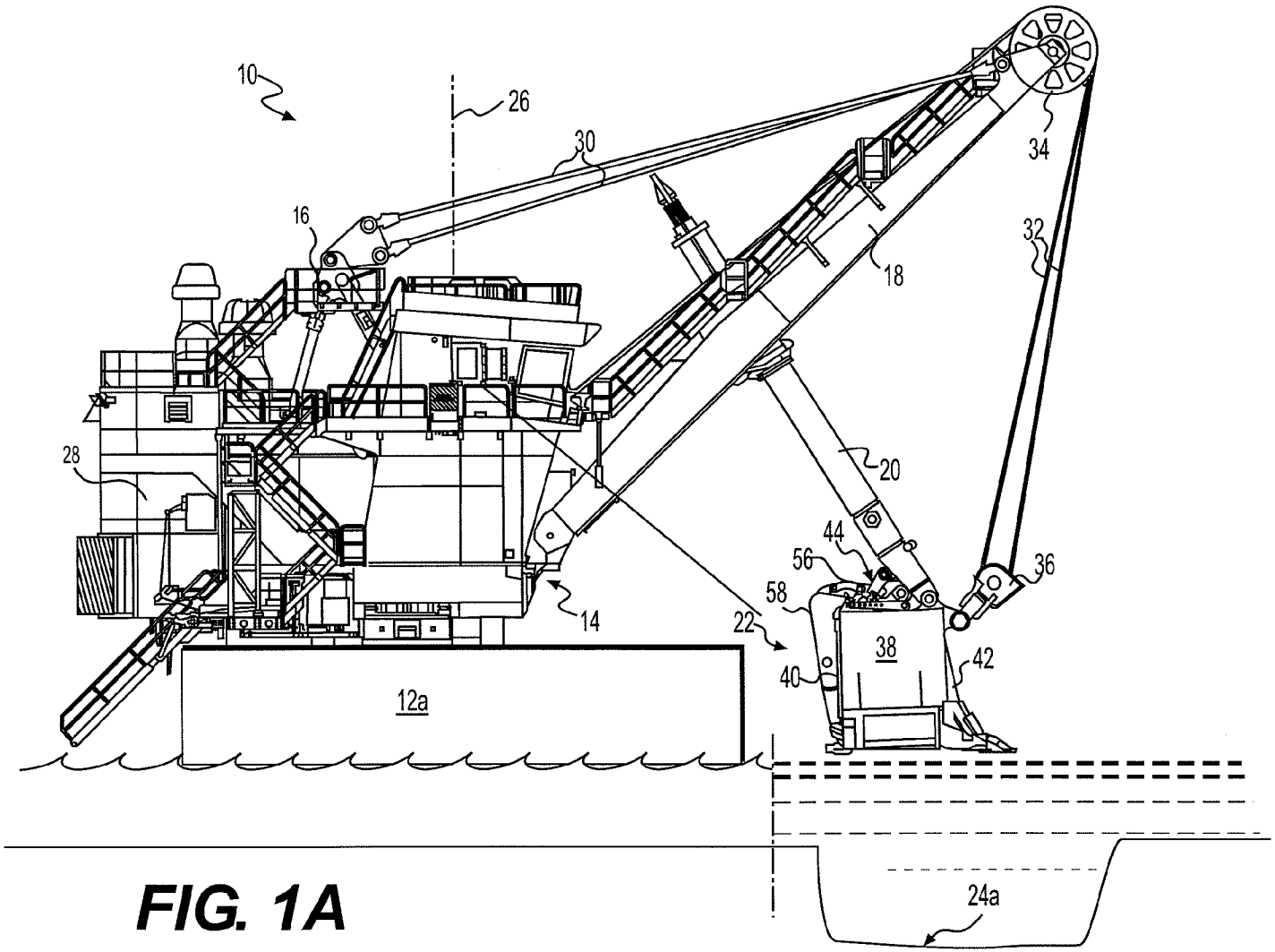
FIG. 1*a* is a diagrammatic illustration of another exemplary disclosed machine.

FIGS. 1 and 1*a* illustrate exemplary embodiments of a machine 10. Machine 10 may perform some type of operation associated with an industry such as mining, construction, or any other industry known in the art. For example, machine 10 may embody an earth moving machine such as the power shovel depicted in FIG. 1 or the dredge depicted in FIG. 1*a*. In the embodiment of FIG. 1, machine 10 may include a base 12, a body 14 operatively connected to base 12, a gantry member 16 rigidly mounted to a top side of body 14 opposite base 12, a boom 18 pivotally connected to a leading end of body 14, a dipper handle 20 pivotally connected to a midpoint of boom 18, a tool 22 pivotally connected to a distal end of dipper handle 20, and cabling connecting gantry member 16, boom 18, dipper handle 20, and tool 22. In the exemplary embodiment of FIG. 1*a*, machine 10 may include each of the components noted above, except that base 12 may be placed within a barge 12*a* configured to support machine 10 in aqueous and/or semi-aqueous environments.

Base 12 (or barge 12*a*) may be a structural unit that supports movements of machine 10. In the disclosed exemplary application, base 12 is itself movable, having one or more traction devices such as feet, tracks (shown in FIG. 1), and/or wheels that are driven to propel machine 10 over a work surface 24. In other applications, however, base 12 may be a stationary platform configured for direct engagement with work surface 24. As shown in FIG. 1*a*, in still further embodiments, barge 12*a* may be stationary and/or moveable over a body of water, and a work surface 24*a* may embody an underwater trench and/or other like underwater surface. In exemplary embodiments, at least a portion of barge 12*a* may be configured for fixed engagement with an underwater surface proximate work surface 24*a*.

Body 14 may pivot relative to base 12 or barge 12*a* (FIG. 1*a*). Specifically, body 14 may pivot relative to base 12 or barge 12*a* about a substantially vertical axis 26. As body 14 is pivoted about axis 26, attached gantry member 16, boom 18, dipper handle 20, and tool 22 may likewise pivot to change a radial engagement angle of tool 22 with work surface 24, 24*a*. In the exemplary embodiment of FIG. 1, tool 22 typically engages with the vertical portion of work surface 24, and the horizontal portion of work surface 24 may be formed as a result of such engagement. The horizontal portion of work surface 24 may be removed by tool 22 in subsequent passes and/or by additional machines located proximate word surface 24. Alternatively, in the exemplary embodiment of FIG. 1*a*, tool 22 may engage a working face and/or other portion of work surface 24*a* disposed below the waterline (i.e., underwater). Body 14 may house, among other things, a power source 28 that powers the movements of machine 10. For ease of description, the exemplary embodiment of FIG. 1 will be referred to for the duration of this disclosure unless otherwise specified. It is understood, however, that the exemplary actuator systems and/or other components described herein, as well as their respective methods of operation, may be used with the machines 10 (i.e., the power shovel of FIG. 1 and the dredge of FIG. 1*a*) illustrated in either of FIGS. 1 and 1*a*.

Gantry member 16 may be a structural frame member, for example a general A-frame member, that is configured to anchor one or more cables 30 to body 14. Gantry member 16 may extend from body 14 in a vertical direction away from base 12. Gantry member 16 may be located rearward of boom 18 relative to tool 22 and, in the disclosed exemplary embodiment, fixed in a single orientation and position. Cables 30 may extend from an apex of gantry member 16 to a distal end of boom 18, thereby transferring a weight of boom 18, tool 22, and a load contained within tool 22 into body 14.

Boom 18 may be pivotally connected at a base end to body 14, and constrained at a desired vertical angle relative to work surface 24 by cables 30. Additional cables 32 may extend from body 14 over a pulley mechanism 34 located at the distal end of boom 18 and around a pulley mechanism 36 of tool 22. Cables 32 may connect tool 22 to body 14 by way of one or more motors (not shown), such that a rotation of the motors functions to reel in or spool out cables 32. The reeling in and spooling out of cables 32 may affect the height and angle of tool 22 relative to work surface 24. For example, when cables 32 are reeled in, the decreasing effective length of cables 32 may cause tool 22 to rise and tilt backward away from work surface 24. In contrast, when cables 32 are spooled out, the increasing effective length of cables 32 may cause tool 22 to lower and tilt forward toward work surface 24.

Dipper handle 20 may be pivotally connected at one end to a general midpoint of boom 18, and at an opposing end to a corner of tool 22 adjacent pulley mechanism 36 (e.g., rearward of pulley mechanism 36). In this position, dipper handle 20 may function to maintain a desired distance of tool 22 away from boom 18 and ensure that tool 22 moves through a desired arc as cables 32 are reeled in and spooled out. In the disclosed embodiment, dipper handle 20 may be connected to boom 18 at a location closer to the base end of boom 18, although other configurations are also possible. In some configurations, dipper handle 20 may be provided with a crowd cylinder (not shown) that functions to extend or retract dipper handle 20. In this manner, the distance between tool 22 and boom 18 (as well as the arcuate trajectory of tool 22) may be adjusted.

Tool 22, in the disclosed embodiment, is known as a dipper. A dipper is a type of shovel bucket having a dipper body 38, and a dipper door 40 located at a back side of dipper body 38 opposite a front side excavation opening 42. Dipper door 40 may be hinged along a base edge at the back side of dipper body, so that it can be selectively pivoted to open and close dipper body 38 during an excavating operation. Dipper door 40 may be pivoted between the opened and closed positions by gravity, and held closed or released by way of a dipper actuator 44. For example, when tool 22 is lifted upward toward the distal end of boom 18 by reeling in of cables 32, a releasing action of dipper actuator 44 may allow the weight of dipper door 40 (and any material within tool 22) to swing dipper door 40 downward away from dipper body 38. This motion may allow material collected within tool 22 to spill out the back side. In contrast, when tool 22 is lowered toward work surface 24, the weight of dipper door 40 may cause dipper door 40 to swing back toward dipper body 38. Dipper actuator 44 may then be caused to lock dipper door 40 in its closed position.

In the disclosed embodiment, dipper actuator 44 may be remotely controlled, such as by way of an electric signal, a hydraulic signal, a pneumatic signal, a wireless signal, or another type of signal known in the art. It is contemplated, however, that a cable may alternatively be mechanically connected to and used to activate dipper actuator 44, if desired.

Figure 2:
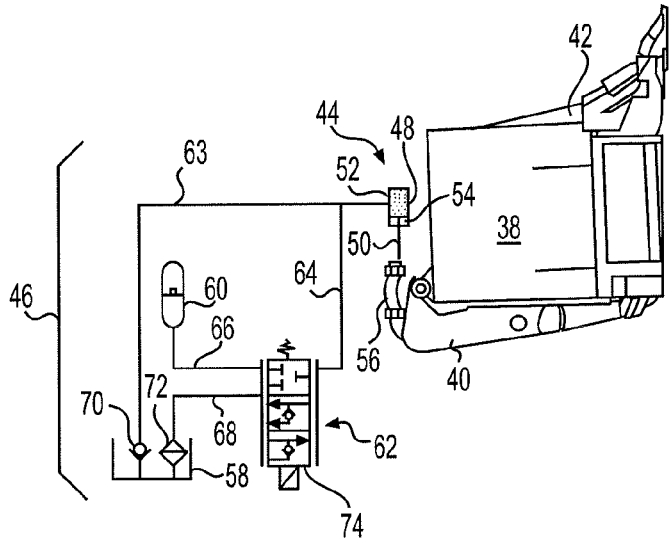
FIGS. 2-4 are schematic illustrations of an exemplary disclosed hydraulic system associated with the machines of FIGS. 1 and 1*a*.

As shown in FIG. 2, dipper actuator 44 may be a powered type of actuator that forms a part of an isolated hydraulic system 46 located at and, in some embodiments, mounted to tool 22. For example, dipper actuator 44 may embody one or more hydraulic cylinders and/or rotary motors that are selectively actuated to initiate the door releasing/locking movements thereof. Hydraulic system 46 may be considered an isolated system, as it may be self-contained and self-powered, not requiring fluid connection or powered support from other components or systems within base 12 or body 14 of machine 10.

In the disclosed example, dipper actuator 44 is a single-acting cylinder operatively connected between dipper body 38 and the base edge of dipper door 40. Specifically, dipper actuator 44 may include a tube 48, and a piston assembly 50 disposed within tube 48 to form a head-end chamber 52 and a rod-end chamber 54. One of tube 48 and piston assembly 50 may be pivotally connected to dipper body 38, while the other may be pivotally connected to dipper door 40 by way of a link 56. As a single-acting cylinder, only one of head-end chamber 52 and rod-end chamber 54 may ever be filled with hydraulic fluid. In the exemplary configuration shown in FIG. 2, head-end chamber 52 functions as the sole pressure chamber for dipper actuator 44. As door 40 opens under the force of gravity (see FIG. 3), piston assembly 50 may be forced to retract into tube 48, thereby discharging any fluid within head-end chamber 52 at high-pressure from dipper actuator 44. In contrast, as door 40 closes under the force of gravity (see FIG. 4), piston assembly 50 may be forced to extend from tube 48, thereby drawing low-pressure fluid into head-end chamber 52. It is contemplated that rod-end chamber 54 could alternatively function as the sole pressure chamber for dipper actuator 44 (e.g., when the orientation of dipper actuator 44 is reversed), if desired. It is further contemplated that dipper actuator 44 could alternatively be a double-acting cylinder. It should be noted that, in some embodiments, more than one substantially identical dipper actuator 44 may be associated with a single tool 22. In these embodiments, the dipper actuators 44 may be disposed in parallel and controlled simultaneously to cooperatively open and close dipper door 40.

Hydraulic system 46 may include additional components that interact with dipper actuator(s) 44 to selectively allow or block movement of dipper door 40, as well as recuperate energy associated with the movement. In particular, hydraulic system 46 may include a low-pressure reservoir 58, an accumulator 60, and a control valve 62 disposed between dipper actuator 44, reservoir 58, and accumulator 60. Low-pressure reservoir 58 may be fluidly connected to dipper actuator 44 via a supply passage 63, while control valve 62 may be fluidly connected to dipper actuator 44 via a control passage 64. Control valve 62 may also be fluidly connected to accumulator 60 and to reservoir 58 via a high-pressure passage 66 and a low-pressure passage 68, respectively. A check valve 70 may be disposed within supply passage 63 to help ensure a unidirectional flow of fluid from reservoir 58 into head-end chamber 52. A filter 72 may be disposed within low-pressure passage 68 to remove debris from circulation within hydraulic system 46.

Reservoir 58 may constitute a low-pressure vessel configured to hold a supply of fluid. The fluid may include, for example, a dedicated hydraulic oil for use by only dipper actuator 44. Reservoir 58 may be substantially isolated from other circuits and systems of machine 10, and remotely located at dipper actuator 44. For the purposes of this disclosure, being remotely located at dipper actuator may be encompass any mounting configuration where reservoir 58 is mechanically connected to dipper actuator 44, to dipper body 38, to dipper door 40, to link 56, and/or to the distal end of dipper handle 20 (referring to FIG. 1). In any of these locations, the length of supply passage 63 and/or low-pressure passage 68 may be small, thereby improving packaging and/or reliability of hydraulic system 46.

Accumulator 60 may embody a pressure vessel filled with a compressible gas that is configured to store pressurized fluid for future use by dipper actuator 44 and/or other actuators associated with tool 22. The compressible gas may include, for example, nitrogen, argon, helium, or another appropriate compressible gas. As fluid in communication with accumulator 60 exceeds a pressure of accumulator 60, the fluid may flow into accumulator 60. Because the gas therein is compressible, it may act like a spring and compress as the fluid flows into accumulator 60. When the pressure of the fluid within high-pressure passage 66 drops below the pressure of accumulator 60, the compressed gas may expand and urge the fluid from within accumulator 60 to exit. It is contemplated that accumulator 60 may alternatively embody a membrane/spring-biased or bladder type of accumulator, if desired. Similar to reservoir 58, accumulator 60 may be remotely located at dipper actuator 44. This may be encompass any mounting configuration where accumulator 60 is mechanically connected to dipper actuator 44, to dipper body 38, to dipper door 40, to link 56, to the distal end of dipper handle 20, and/or to reservoir 58. In any of these locations, the length of high-pressure passage 66 may be small, thereby improving packaging and/or reliability of hydraulic system 46.

Control valve 62 may include a valve element 74 movable between different positions to selectively allow fluid to flow between head-end chamber 52 of dipper actuator 44, accumulator 60, and reservoir 58. For example, valve element 74 may be movable from a first position (shown in FIG. 2), at which fluid flow between head-end chamber 52, accumulator 60, and reservoir 58, via control valve 62, may be inhibited, to a second (shown in FIG. 3) or a third (shown in FIG. 4) flow-passing position.

When valve element 74 is in the second flow-passing position, head-end chamber 52 may be fluidly connected to accumulator 60 such that high-pressure fluid discharging from head-end chamber 52 may be collected within accumulator 60. In some embodiments, when valve element 74 is in the second flow-passing position, the high-pressure fluid, when it exceeds the opening pressure of a first internal check valve, may also be directed into reservoir 58, if desired. In this manner, hydraulic system 46 may be protected from overpressure events.

When valve element 74 is in the third flow-passing position, head-end chamber 52 may be fluid connected to accumulator 60 such that high-pressure fluid previously collected in accumulator 60 may flow back into head-end chamber 52. In some embodiments, when valve element 74 is in the third flow-passing position and the pressure of fluid in control passage 64 falls below an opening pressure of a second internal check valve, fluid may also be drawn from reservoir 58 for supply to head-end chamber 52, if desired. In this manner, hydraulic system 46 may be protected from voiding or cavitation caused be excessively low-pressures.

It is contemplated that the third flow-passing position of valve element 74 may be omitted, if desired. In this alternative embodiment, head-end chamber 52 may only be replenished with fluid via supply passage 63. Alternatively, the functionality of the third flow-passing position could be incorporated into the second flow-passing position. That is, when valve element 74 is in the second flow-passing position, fluid may flow through control valve 62 in either direction (i.e., from dipper actuator 44 to accumulator 60 or from accumulator 60 to dipper actuator 44).

Movement of valve element 74 may be controlled to regulate operation of dipper actuator 44 and tool 22. Specifically, valve element 74 may be solenoid operable to move from the first position to either of the second or third flow-passing positions based on a wired or wirelessly transmitted control signal generated by an operator of machine 10. Valve element 74 may be spring-biased toward the first position. When valve element 74 is moved to the first position (referring to FIG. 2) and all fluid flow through control valve 62 is inhibited, dipper actuator 44 may be hydraulically locked. That is, fluid within head-end chamber 52 may be trapped when valve element 74 is in the first position, thereby blocking extension and retraction of piston assembly 50. When dipper door 40 is closed and dipper actuator 44 is hydraulically locked, it may not be possible for dipper door 40 to open.

In contrast, when valve element 74 is moved to the second flow-passing position (referring to FIG. 3), dipper actuator 44 may no longer be hydraulically locked. In this state, when dipper body 38 is oriented upward (i.e., such that excavation opening 42 is oriented away from work surface 24) and the force of dipper door 40 (and any material contained within dipper body 38) urges dipper door 40 to rotate clockwise (as viewed in FIG. 3) toward work surface 24, piston assembly 50 may be forced to retract within tube 48 and push fluid out of head-end chamber 52 at high pressure. This high-pressure fluid, containing significant potential energy in the form of pressure, may be directed from dipper actuator 44 through control valve 62 and into accumulator 60 where it may be collected and stored for later use.

When valve element 74 is moved to the third flow-passing position and dipper body 38 is oriented forward (e.g., rotated about 90° clockwise from the upward orientation), the gravitational force acting on dipper door 40 may urge dipper door 40 to rotate counterclockwise (as viewed in FIG. 4), causing piston assembly 50 to extend from tube 48 and draw in fluid from reservoir 58 via supply passage 63 and/or accumulator 60 via control valve 62.

Control valve 62 may additionally be used as a snubber for dipper actuator 44, if desired. In particular, in some embodiments, control valve 62 may be moveable to a position between the first and second positions and/or to a position between the first and third positions. In either of these intermediate positions, the flow of fluid from head-end chamber 52 and/or into head-end chamber 52 may be metered to a rate that effectively slows and cushions the pivoting movement of dipper door 40.

Figure 4:
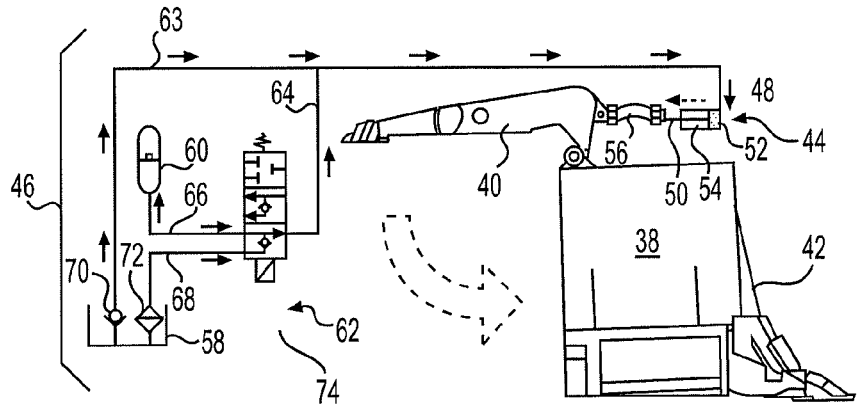
Figure 5:
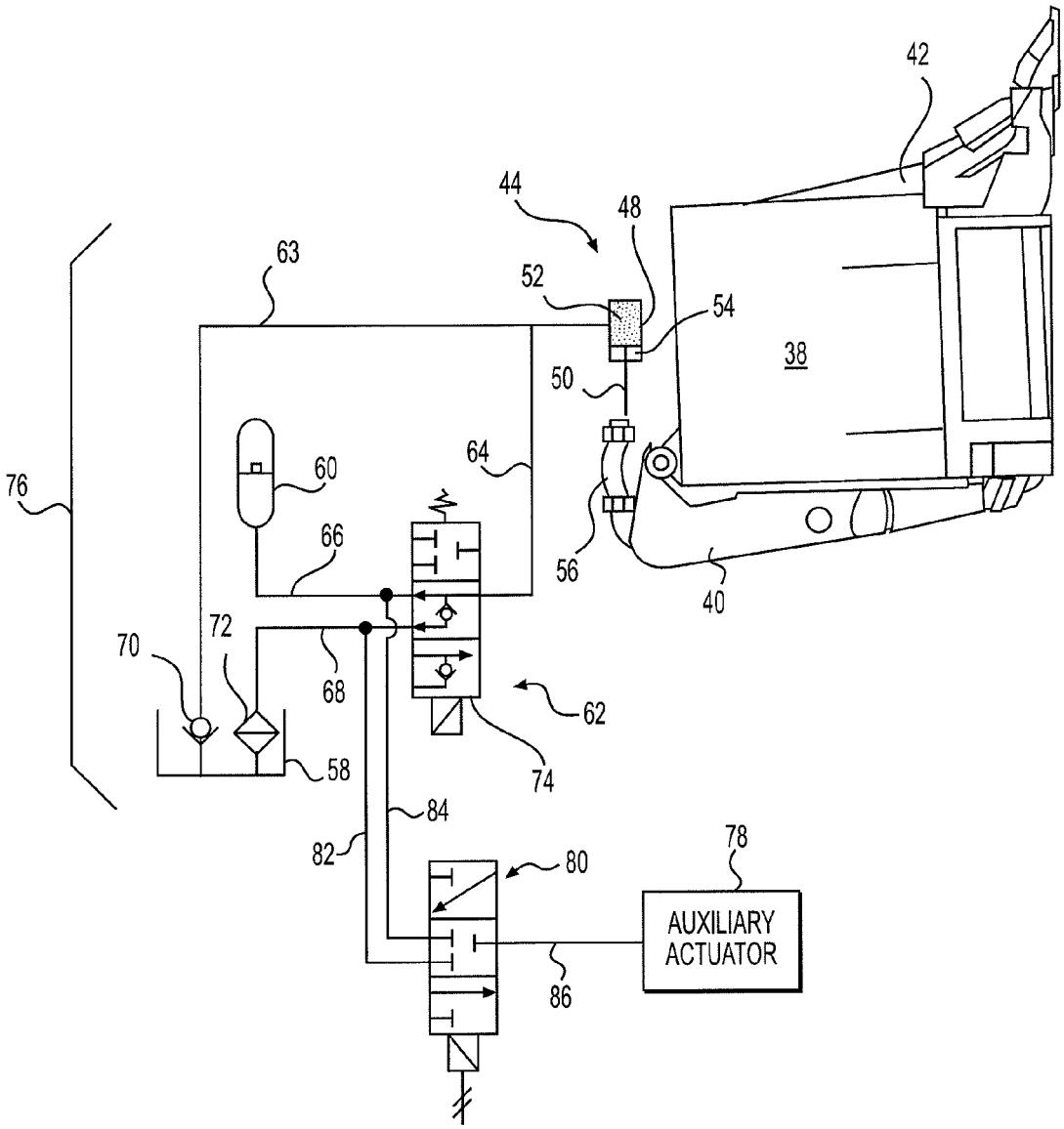
FIG. 5 is a schematic illustration of another exemplary disclosed hydraulic system associated with the machines of FIGS. 1 and 1*a*.

An alternative hydraulic system 76 is illustrated in FIG. 5. Like hydraulic system 46 of FIGS. 2-4, hydraulic system 76 of FIG. 5 may include dipper actuator 44, reservoir 58, accumulator 60, control valve 62 supply passage 63, control passage 64, high-pressure passage 66, and low-pressure passage 68. In addition, hydraulic system 76 may include an auxiliary actuator 78, and an auxiliary control valve 80 disposed between reservoir 58, accumulator 60, and auxiliary actuator 78. A low-pressure passage 82 may connect auxiliary control valve 80 to reservoir 58; a high-pressure passage 84 may connect auxiliary control valve 80 to accumulator 60; and a control passage 86 may connect auxiliary control valve 80 to auxiliary actuator 78. In this configuration, auxiliary control valve 80 may be configured to selectively direct high-pressure fluid that was previously collected from dipper actuator 44 within accumulator 60 to auxiliary actuator 78 for reuse, and return waste fluid from auxiliary actuator 78 to reservoir 58. Auxiliary actuator 78 may be, for example, an automatic greater that provides lubricant to different pins and/or bearings of tool 22. It is contemplated that other actuators may also or alternatively be powered by the high-pressure fluid collected within accumulator 60, if desired.

INDUSTRIAL APPLICABILITY

The disclosed dipper actuator and associated hydraulic system may be used in any power shovel application where component longevity and reliability are desired. The disclosed dipper actuator may have improved longevity due to its remote power supply and wireless control. The disclosed dipper actuator may have improved reliability because of the reduction of conventional components (e.g., cables, wires, passages, etc.) that stretch and shrink during dipper handle extensions and retractions. Operation of hydraulic system 46 and dipper actuator 44 will now be explained.

Referring to FIG. 1, the operator of machine 10 may raise, lower, and tilt tool 22 by causing cables 32 to be reeled in or spooled out. When tool 22 is oriented in the appropriate position (oriented such that the force of gravity generates a clockwise moment on dipper door 40) and the operator of machine 10 desires dipper door 40 of tool 22 to open, the operator may indicate this desire by way of an input device (not shown) located within the cabin of machine 10. A corresponding signal may be generated and wirelessly transmitted to dipper control valve 62, causing dipper valve element 74 to move against its spring bias from its first position (upper position shown in FIG. 2) to its second flow-passing position (middle position shown in FIG. 3). When valve element 74 is in its second position, dipper actuator 44 may be hydraulically unlocked and fluid within head-end chamber 52 may be free to flow through control valve 62 into accumulator 60 and/or into reservoir 58. At this time, the gravitational force acting on dipper door 40 may cause dipper door 40 to rotate away from dipper body 38 and push piston assembly 50 into tube 48. This retraction of piston assembly 50 may effectively reduce the volume of head-end chamber 52, causing fluid to be discharged from dipper actuator 40 at high-pressure. The high-pressure fluid may be collected within accumulator 60 for later use. In some embodiments, the flow of fluid discharging from head-end chamber 52 may be restricted to some degree to slow and/or cushion the opening movements of dipper door 40. It is important to note that movement of control valve 62 may not necessarily result in movement of dipper door 40 or dipper actuator 44. Dipper door 40 and dipper actuator 44 may only move when tool 22 is oriented to allow gravity to pull dipper door 40 open after dipper actuator 44 has been unlocked by movement of control valve 62. If either condition is not satisfied (i.e., if control valve 62 has not been unlocked or dipper door 40 is not oriented properly), dipper door 40 may not open.

Figure 3:
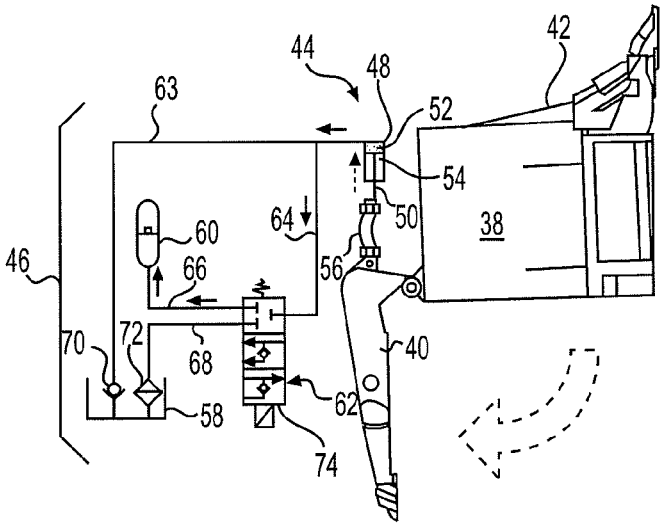

Dipper door 40 may close any time its orientation is such that gravity pulls dipper door 40 closed (i.e., any time that gravity generates a moment in the counterclockwise direction—as viewed in FIGS. 2-4). During the closing movement of dipper door 40, piston assembly 50 may be retracted out of tube 48, thereby increasing the effective volume of head-end chamber 52. This expansion may draw fluid from reservoir 58 through supply passage 63 into dipper actuator 44. It some embodiments, control valve 62 may additionally or alternatively be used to supply fluid to head-end chamber 52, if desired. In particular, valve element 74 may be moved to its third flow-passing position (lowermost position shown in FIG. 4) during closing movements of dipper door 40. When in this position, high-pressure fluid from within accumulator 60 may be sent back to dipper actuator 44 thereby assisting the closing movements of dipper door 40 and/or reducing a likelihood of voiding in head-end chamber 52 during the closing of dipper door 40.

Accumulator 60 may be used for different purposes and provide several benefits. First, collecting high-pressure fluid within accumulator 60 during door opening movements may provide a back-pressure to dipper actuator 44 that resists and thereby slows the opening movements. This cushioning may be enhanced through metering of the fluid flowing from dipper actuator 44 into accumulator 60. Second, the redirection of collected high-pressure fluid back into dipper actuator 44 during door closing movements may reduce a likelihood of voiding within dipper actuator 44. Third, the collected high-pressure fluid may be used as a remote power source for other actuators associated with tool 22 (referring to FIG. 3). The remote and isolated nature of hydraulic system 46 may reduce cost and routing complexity, while at the same time improving durability of machine 10.

It will be apparent to those skilled in the art that various modifications and variations can be made to the disclosed power shovel and dipper actuator. Other embodiments will be apparent to those skilled in the art from consideration of the specification and practice of the disclosed power shovel and dipper actuator. It is intended that the specification and example be considered as exemplary only, with a true scope being indicated by the following claims and their equivalents.

What is claimed is:

1. A hydraulic system for a power shovel, comprising:
a cylinder operatively connectable to a dipper door of the power shovel;
a reservoir located at and fluidly connected to the cylinder;
an accumulator located at and fluidly connected to the cylinder in parallel with the reservoir; and
a control valve disposed between the cylinder, the reservoir, and the accumulator, the control valve being movable to selectively direct fluid from the cylinder into the accumulator and fluid from the reservoir into the cylinder.

2. The hydraulic system of claim 1, wherein at least one of the reservoir and the accumulator is mountable to a dipper body of the power shovel.

3. The hydraulic system of claim 1, wherein the reservoir and the accumulator are fluidly connected to a single chamber of the cylinder.

4. The hydraulic system of claim 1, wherein the cylinder is a single-acting cylinder.

5. The hydraulic system of claim 1, wherein the control valve is further movable to selectively direct fluid from the accumulator into the cylinder.

6. The hydraulic system of claim 1, wherein:
the control valve is a first control valve; and
the hydraulic system further includes:
an auxiliary actuator; and
a second control valve configured to direct fluid from the accumulator into the auxiliary actuator and from the auxiliary actuator into the reservoir.

7. The hydraulic system of claim 1, wherein motion of the dipper door is the sole source of power for pressurizing fluid in the hydraulic system.

8. The hydraulic system of claim 1, wherein the cylinder is connectable between a dipper body and a base edge of the dipper door.

9. A hydraulic system for a power shovel, comprising:
a cylinder operatively connectable between a dipper body and a base edge of a dipper door;
an accumulator fluidly connected to the cylinder; and
a control valve disposed between the cylinder and the accumulator, the control valve being movable to selectively actuate the cylinder to release and lock pivoting movement of the dipper door.

10. The hydraulic system of claim 9, wherein the accumulator is mountable to the dipper body.

11. The hydraulic system of claim 9, wherein the accumulator is fluidly connected to a single chamber of the cylinder.

12. The hydraulic system of claim 9, wherein the cylinder is a single-acting cylinder.

13. The hydraulic system of claim 9, wherein the control valve is further movable to selectively direct fluid from the cylinder into at least one of the accumulator and from the accumulator into the cylinder.

14. The hydraulic system of claim 13, wherein:
the control valve is a first control valve; and
the hydraulic system further includes:
an auxiliary actuator; and
a second control valve configured to direct fluid from the accumulator into the auxiliary actuator and from the auxiliary actuator into a low-pressure reservoir.

15. The hydraulic system of claim 9, wherein motion of the dipper door is the sole source of power for pressurizing fluid in the hydraulic system.

16. A power shovel, comprising:
a body;
a boom pivotally connected at a base end to the body;
a dipper handle pivotally connected at a base end to a midpoint of the boom;
a dipper pivotally connected to a distal end of the dipper handle, the dipper having a dipper body and a dipper door pivotally connected at a base edge to the dipper body;
a single-acting cylinder connected at a first end to the dipper body;
a link connecting an opposing second end of the single-acting cylinder to the base edge of the dipper door;
a reservoir located at the dipper and fluidly connected to the single-acting cylinder;
an accumulator located at the dipper and fluidly connected to the single-acting cylinder in parallel with the reservoir;
a first control valve disposed between the single-acting cylinder, the reservoir, and the accumulator, the first control valve being movable to selectively direct fluid from the single-acting cylinder into the accumulator and fluid from the reservoir into the single-acting cylinder;
an auxiliary actuator; and
a second control valve disposed between the accumulator and the auxiliary actuator, the second control valve being movable to selectively direct fluid from the accumulator to the auxiliary actuator and from the auxiliary actuator to the reservoir.

17. A method of operating a power shovel, comprising:
releasing fluid from a cylinder to allow a dipper door of the power shovel to pivot in a first direction under the force of gravity;
accumulating high-pressure fluid discharged from the cylinder during pivoting of the dipper door in the first direction; and
directing low-pressure fluid from a reservoir into the cylinder during pivoting of the dipper door in a second direction under the force of gravity.

18. The method of claim 17, further including hydraulically locking the cylinder to inhibit pivoting of the dipper door.

19. The method of claim 18, further including:
directing accumulated high-pressure fluid to an auxiliary actuator; and
returning low-pressure fluid to the reservoir.

20. The method of claim 19, wherein motion of the dipper door is the sole source of power for pressurized fluid in cylinder.

* * * * *